United States Patent [19]

Fedder et al.

[11] Patent Number: 4,975,069

[45] Date of Patent: Dec. 4, 1990

[54] ELECTRICAL MODULAR CONNECTOR

[75] Inventors: James L. Fedder, Etters; Matthew M. Sucheski, Harrisburg, both of Pa.

[73] Assignee: AMP Incorporated, Harrisburg, Pa.

[21] Appl. No.: 430,700

[22] Filed: Nov. 1, 1989

[51] Int. Cl.[5] ..... H01R 4/66

[52] U.S. Cl. ..... 439/101; 439/497

[58] Field of Search ..... 439/497, 101

[56] References Cited

U.S. PATENT DOCUMENTS

| | | | |
|---|---|---|---|
| 3,656,093 | 4/1972 | Kinkaid | 339/217 S |
| 3,720,907 | 3/1973 | Asick | 339/176 MP |
| 4,655,518 | 4/1987 | Johnson et al. | 339/17 LC |
| 4,781,620 | 11/1988 | Tengler et al. | 439/497 |
| 4,867,690 | 9/1989 | Thumma | 439/79 |

*Primary Examiner*—Eugene F. Desmond

*Attorney, Agent, or Firm*—Allan B. Osborne

[57] ABSTRACT

An electrical modular connector (10) for interconnecting electrical wires to another connector is disclosed. The connector (10) includes signal and ground contacts (14,46) having a receptacle (38,50) at one end for engaging posts in a pin header and tabs (36,56) at another end to which the wires may be welded. Further, the ground contacts (46) include shielding plates (56) to maintain signal integrity in high speed applications.

3 Claims, 6 Drawing Sheets

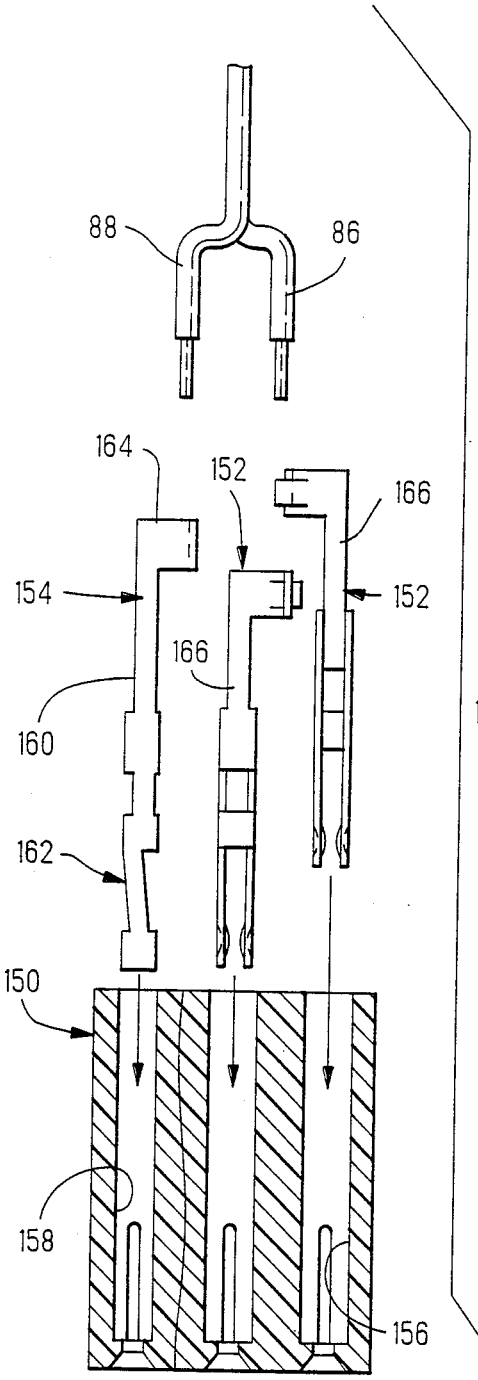
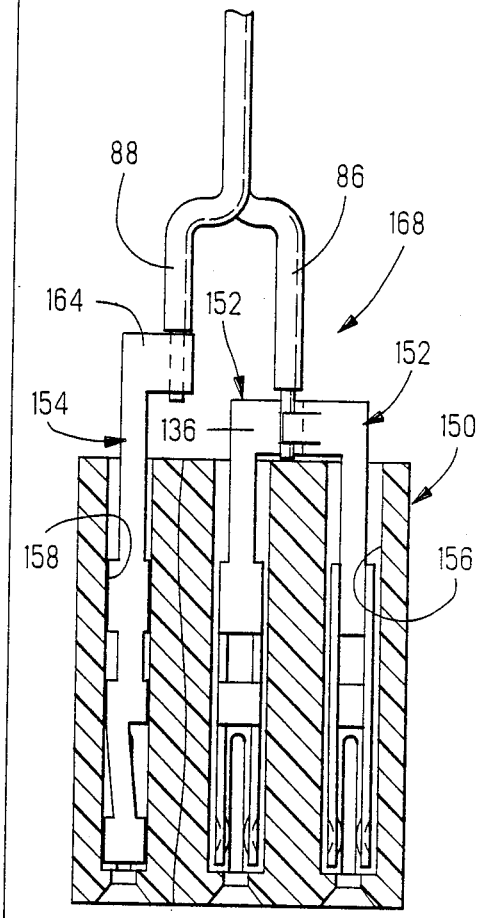
FIG. 6B
FIG. 6A

ELECTRICAL MODULAR CONNECTOR

FIELD OF THE INVENTION

The invention disclosed herein relates to electrical modular connectors which electrically connect discrete electrical wires to conductive traces on a printed circuit board through an intermediate mating connector and further to provide shielding for signal integrity.

BACKGROUND OF THE INVENTION

Electrical connectors are known which electrically connect discrete conductors to conductive traces on a printed circuit board. U.S. Pat. Nos. 3,656,093 and 3,720,907 exemplify such connectors. In each disclosure, the conductors are crimped to a wire barrel on the terminals which are positioned in cavities in the connector housing. The terminals include a pair of cantilever arms between which the circuit board is received with the conductive traces thereon being engaged by the cantilever arms. These connectors function quite well in low speed applications but are inadequate for use in high speed electronic equipment because of cross talk and ground bounce problems. Accordingly, it is now proposed to provide a modular electrical connector which includes shielding to maintain signal integrity in high speed applications.

SUMMARY OF THE INVENTION

According to the invention, a modular electrical connector is provided which includes a dielectric housing having a row of signal passages and, at least at one end of and offset from the row of signal passages, a ground passage. Further provided are signal contacts positioned in the signal passages and a ground contact positioned in the ground passage. The ground contact is provided with a shielding plate to provide signal integrity.

BRIEF DESCRIPTION OF THE DRAWINGS

FIGS. 6A and 6B are views of yet another embodiment of a connector of the present invention with the housing being sectioned.

DESCRIPTION OF THE INVENTION

Figure 1:
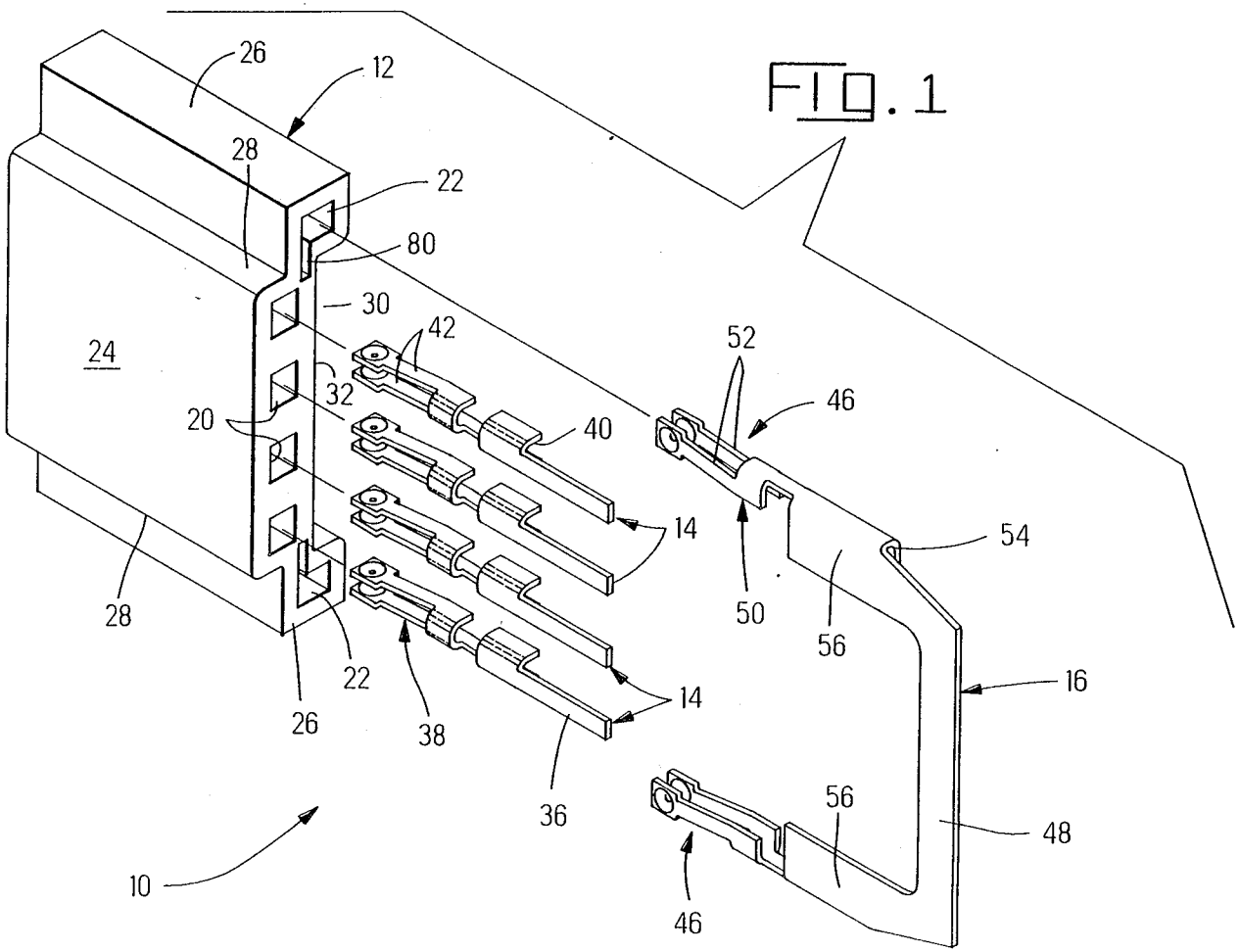
FIG. 1 is a perspective view of a modular connector constructed in accordance with one embodiment of the present invention.

FIG. 1 shows modular connector 10 which may be referred to as a receptacle in the industry. Connector 10 may stand alone or in a stack of connectors 10 such as shown in FIG. 3B. Connector 10 includes housing 12, signal contacts 14 and ground unit 16. Housing 12 is molded from a dielectric material such as polyphenylene sulfide resin and is provided with signal passages 20 and ground passages 22. Passages 20 are within body 24 and passages 22 are within arms 26 which are attached to respective ends 28 of body 24. Arms 26 project outwardly to define space 30 therebetween and in cooperation with side surface 32 of body 24.

Signal contacts 14 are stamped and formed from a suitable conductive material such as beryllium copper or phosphor bronze. Each contact 14 includes lead 36 at one end and receptacle 38 at another end with a U-shaped retention section 40 positioned therebetween. Receptacle 38 is formed through cooperation between a pair of converging beams 42.

Ground unit 16 includes a pair of spaced apart ground contacts 46 connected together by bar 48. Each contact 46 includes receptacle 50 formed through cooperation between a pair of converging beams 52, U-shaped retention section 54 and shielding plates 56 extending laterally from section 54. Bar 48 is attached to respective ends of and extends between plates 56.

Figure 2:
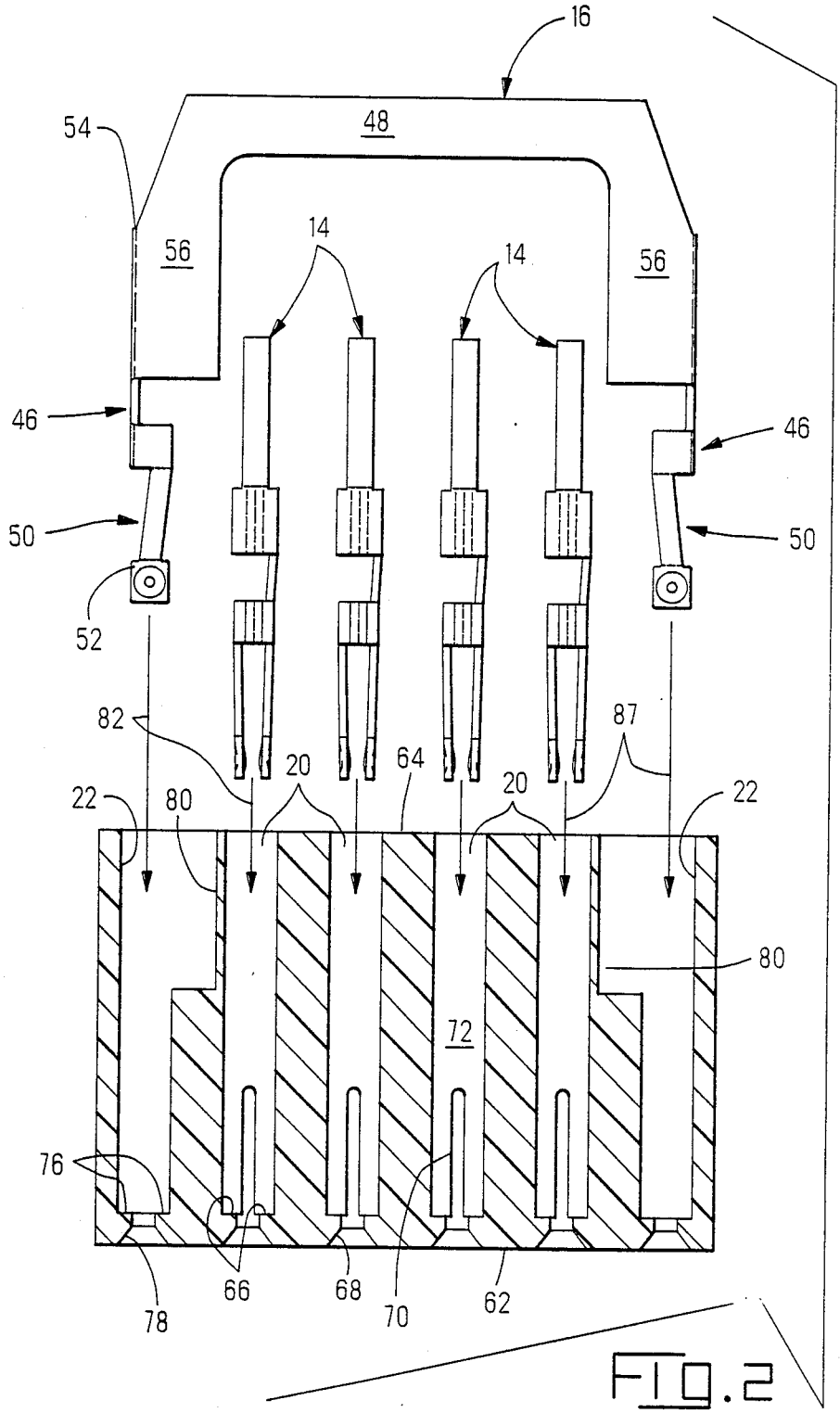
FIG. 2 is a view of the connector of FIG. 1 with the housing sectional to show cavity details.

As shown in FIG. 2, signal passages 20 extend through body 24, opening onto front and rear surfaces 62,64 respectively. Each passage 20 is reduced in width adjacent front surface 62 to define rearwardly facing shoulders 66. Entrances 68 to passages 20 are beveled as shown to guide the male post on a mating pin header (not shown). Ribs 70 are provided in passage walls 72 adjacent entrances 68 to partially spread apart beams 42 on contacts 14 to reduce insertion forces.

Each ground passage 22 includes rearwardly facing shoulders 76 and a funnel shaped entrance 78 similarly to signal passages 20. Further, each passage 22 includes offset slot 80 which opens onto rear surface 64 and extends into body 24, arm 26 a short distance as shown in FIG. 1.

As indicated by arrows 82, contacts 14 and ground unit 16 are loaded into housing 12 from rear surface 64 with the free ends of receptacles 38,50 abutting shoulders 66,76 respectively. Contacts 14 and unit 16 are retained in respective passages 20,20 by U-shaped retention sections 40,54 being frictionally received therein.

Figure 3A:
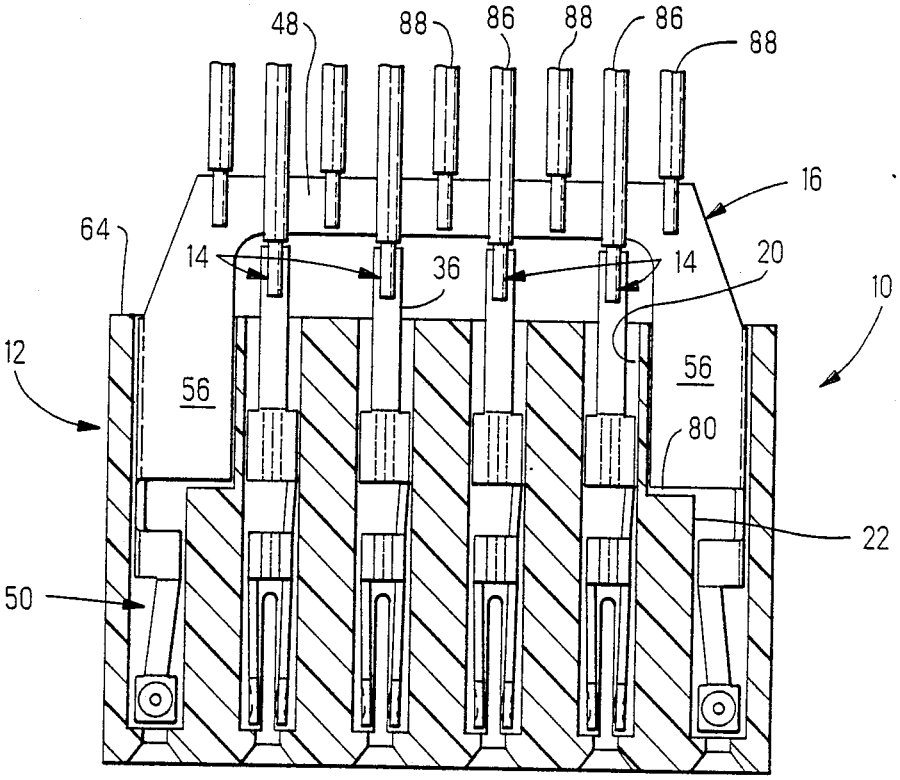
FIG. 3A is a sectional view of the assembled connector.
Figure 3B:
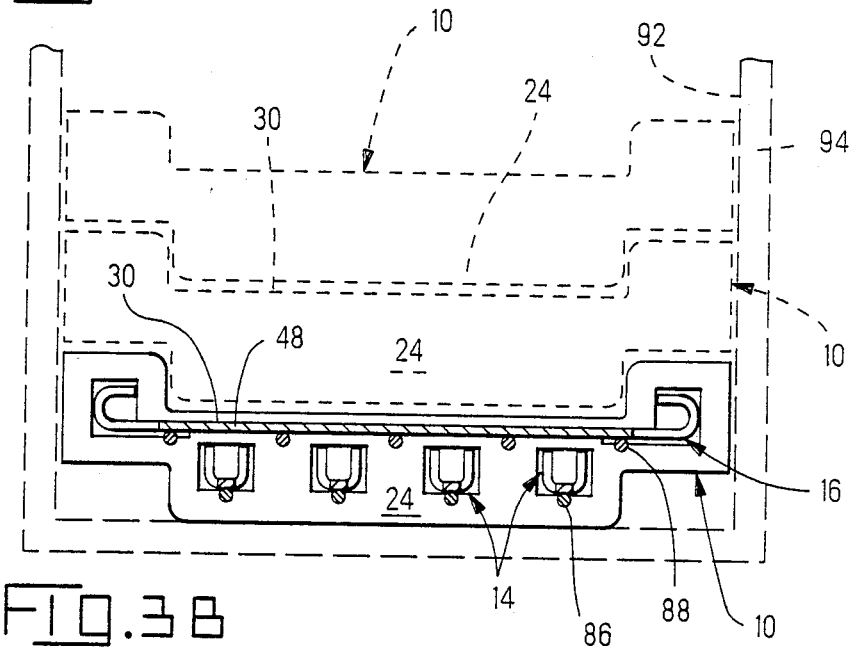
FIG. 3B is a top plan view illustrating a plurality of stacked connectors.

FIG. 3A shows module 10 with contacts 14 and unit 16 positioned in housing 12. The figure also shows signal wires 86 welded to respective leads 36 on elements 14 and ground wires 88 welded to bar 48 on unit 16. As shown, side plates 56 extend into slots 80. Note also that leads 36 and bar 48 extend beyond rear surface 64 of housing 12. If required, a hood (not shown) or like protective cover may be placed over the rear of module 10.

FIG. 3B shows several modules 10 stacked side by side in cavity 92 in pin header 94. Bodies 24 fit into spaces 30 of the adjacent module 10 and that ground unit 16 provides a shield between respective signal contacts 14 in adjacent modules 10.

Figures 4A, 4B:
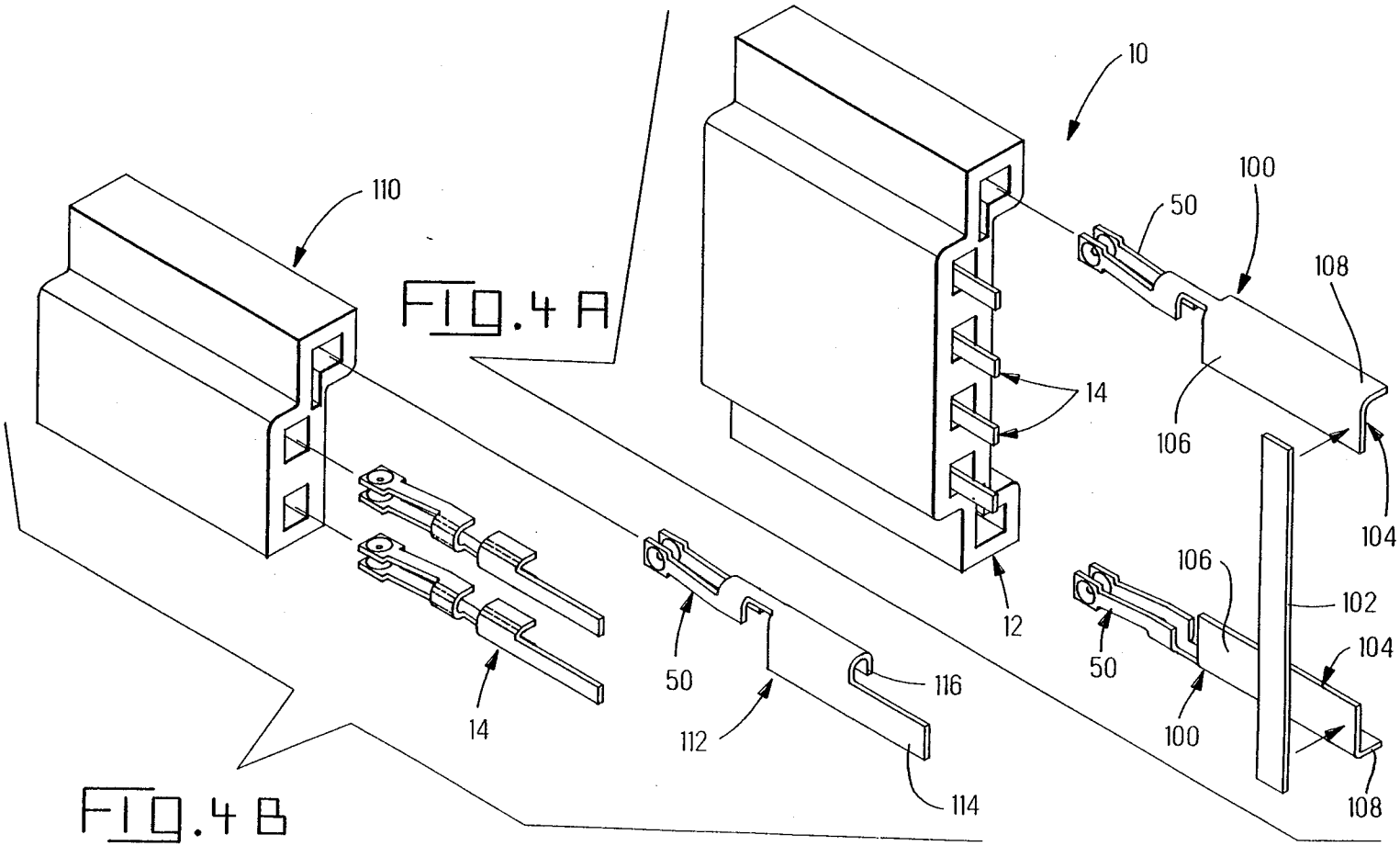
FIG. 4A is a perspective view of another embodiment of a connector of the present invention.
FIG. 4B is a perspective view of a modified embodiment of the connector of FIG. 4A.

FIG. 4A shows a modification of ground unit 16. Included are two ground contacts 100 and tie strap 102. Each contact 100 includes the twin beam receptacle 50 at one end and an L-shaped section 104 at another end. Section 104 includes side plate 106 and a short width edge plate 108. Not shown is a U-shaped retention section which is formed in cooperation with edge plate 108 adjacent receptacle 50. Tie strap 102 may be welded to respective side plates 106 if both contacts 100 are being used for shielding and grounding purposes. Where one will be used for power transmission, strap 102 will be omitted.

FIG. 4B shows modular connector 110 which is one half of connector 10. Ground contacts 112 include lead 114 to which a ground wire (not shown) may be welded, U-shaped retention section 116 and receptacle 50.

Figure 5:
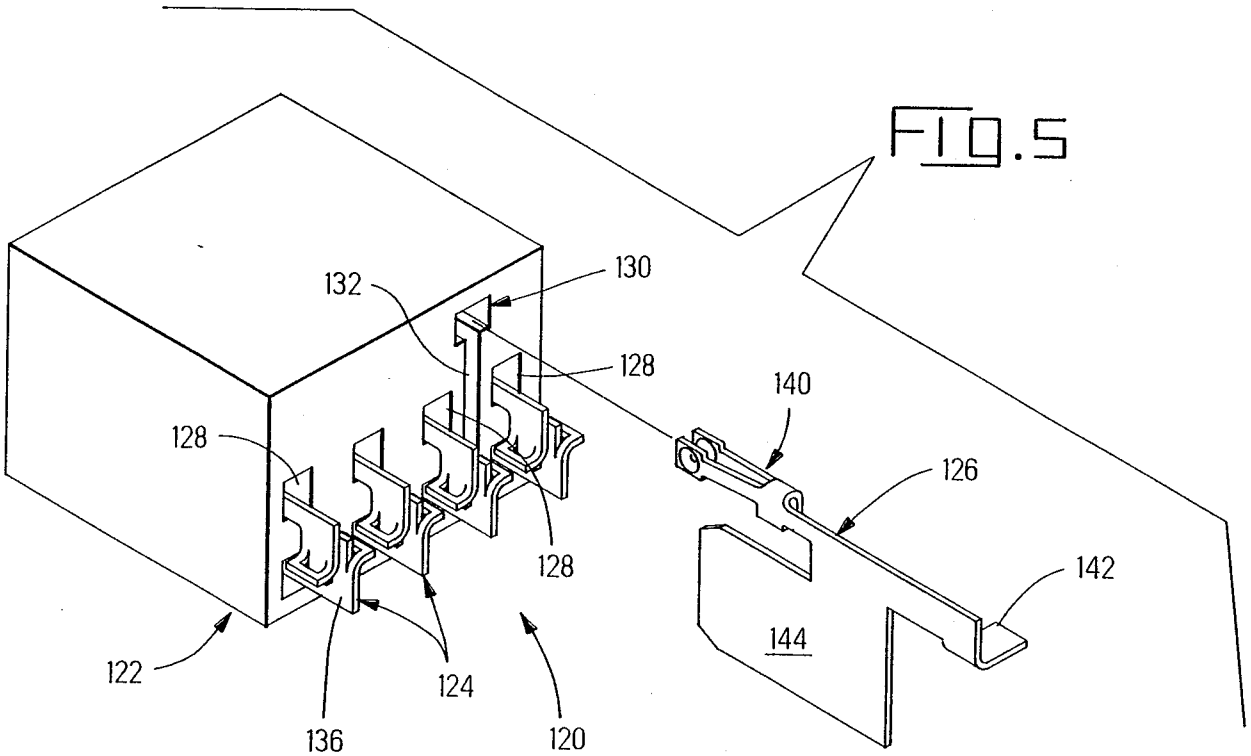
FIG. 5 is still another embodiment of a connector of the present invention.

FIG. 5 illustrates connector 120 which includes housing 122, signal contacts 124 and a ground contact 126. Housing 122, molded from a dielectric material such as polyphene sulfide resin, includes passages 128 which are substantially the same structurally as passages 20 and one passage 130. Passage 130 includes slot 132 extending between a pair of passages 128.

Signal contacts 124 include a receptacle (not shown) which is identical with receptacle 38. At the other end, an L-shaped portion 136 is provided to which signal wire 86 is welded.

Ground contact 126 includes receptacle 140 at one end, L-shaped portion 142 to which ground wire 88 is welded and shielding plate 144 extending laterally from strap 146 which connects receptacle 140 and portion 142.

As can be seen, ground contact 126, when positioned in passage 130, provides a shield between adjacent signal contacts 124 by means of plate 144 being positioned in slot 132.

FIG. 6A shows an alternative embodiment comprising housing 150, signal contacts 152 and ground contact 154. Housing 150 includes signal passages 156 and ground passage 158. These passages 156,158 are identical to passages 20 shown in FIG. 2. Signal contacts 152 are identical to signal contacts 124 shown in FIG. 5. Ground contact 154 is identical to signal contacts 152,124 with the exception that intermediate strap 160, located between receptacle 162 and L-shaped portion 164, is longer than the corresponding strap 166 on contacts 152.

FIG. 6B shows modular connector 168 formed from the components shown in FIG. 6A. Signal wires (only one shown) 86 are welded to L-shaped portions 136 on signal contacts 152 and ground wire 88 is welded to L-shaped portion 164 on ground contact 154 which extends outwardly from housing 150 further that portion 136.

As can be discerned an electrical modular connector has been disclosed for interconnecting discrete signal wires to a circuit board through a mating connector and which includes shielding contacts for maintaining signal integrity. The connector as illustrated in one embodiment includes a housing carrying a row of signal contacts with a shielding plate adjacent thereto and with the plate attached to one or two ground contacts which are contained in passages offset from the passages containing the signal contacts.

We claim:

1. An electrical modular connector comprising: a housing having a row of signal passages extending therethrough from top to bottom and with said row being located between respective ends, said housing further having a ground passage extending through respective offset portions of said housing located at respective said ends, said ground passages being open at both top and bottom of said housing;

signal contacts disposed in said signal passages with one end adapted to electrically engage a signal conductor; and ground contacts disposed in said ground passages and electrically interconnected by bar means attached to and extending between said ground contacts and adjacent to and electrically remote from said row of signal contacts, said bar means adapted to have ground conductors associated with said signal conductors electrically attached thereto.

2. The connector of claim 1 wherein said offset portions extend outwardly from a surface of said housing to define a space therebetween with said space adapted to receive a like housing therein.

3. The connector of claim 1 wherein said signal and ground contacts include means for electrically engaging electrical terminals of other electrical devices.

* * * * *